United States Patent [19]

Berke et al.

[11] 4,259,114

[45] Mar. 31, 1981

[54] METHOD FOR FORMING SILVER PRECIPITATING NUCLEI

[75] Inventors: Carl M. Berke, Boston; Barbara A. Baughman, Cambridge, both of Mass.

[73] Assignee: Polaroid Corporation, Cambridge, Mass.

[21] Appl. No.: 108,355

[22] Filed: Dec. 31, 1979

[51] Int. Cl.[1] ..... C23C 3/02

[52] U.S. Cl. ..... 106/1.28; 106/1.05; 106/135; 106/137; 252/313 R; 430/247

[58] Field of Search ..... 106/1.05, 1.11, 1.28, 106/135, 137; 252/313 R; 430/247

[56] References Cited

U.S. PATENT DOCUMENTS

| | | | |
|---|---|---|---|
| 2,698,236 | 12/1954 | Land | 95/8 |
| 2,726,154 | 12/1955 | Land | 430/228 |
| 2,857,274 | 10/1958 | Land et al. | 430/251 |
| 2,861,885 | 11/1958 | Land | 430/229 |
| 2,944,894 | 7/1960 | Land | 96/3 |
| 3,019,124 | 1/1962 | Rogers | 430/207 |
| 3,032,008 | 5/1962 | Land et al. | 425/382 |
| 3,284,208 | 11/1966 | Land | 430/7 |
| 3,536,488 | 10/1970 | Land | 96/24 |
| 3,615,426 | 10/1971 | Debruyn | 430/234 |
| 3,615,427 | 10/1971 | Debruyn | 430/234 |
| 3,615,428 | 10/1971 | Weed | 430/234 |
| 3,615,429 | 10/1971 | Weed | 430/234 |
| 3,615,440 | 10/1971 | Bloom | 430/234 |
| 3,647,440 | 3/1972 | Rasch | 96/29 |
| 3,730,716 | 5/1973 | Land et al. | 430/228 |
| 3,894,871 | 7/1975 | Land | 430/228 |

OTHER PUBLICATIONS

Land, "One Step Photography", *Photographic Journal*, pp. 7–15, Jan. 1950.

*Primary Examiner*—Lorenzo B. Hayes
*Attorney, Agent, or Firm*—Philip G. Kiely

[57] ABSTRACT

Noble metal silver-precipitating nuclei are prepared by reducing a noble metal salt or complex in the presence of a first polymer with a Sn° colloid formed by the non-aqueous borohydride reduction of a tin salt in the presence of an organic solvent for the tin salt and a nitrogen-containing metal chelating polymer. The invention is also directed to film units employing said nuclei.

8 Claims, 1 Drawing Figure

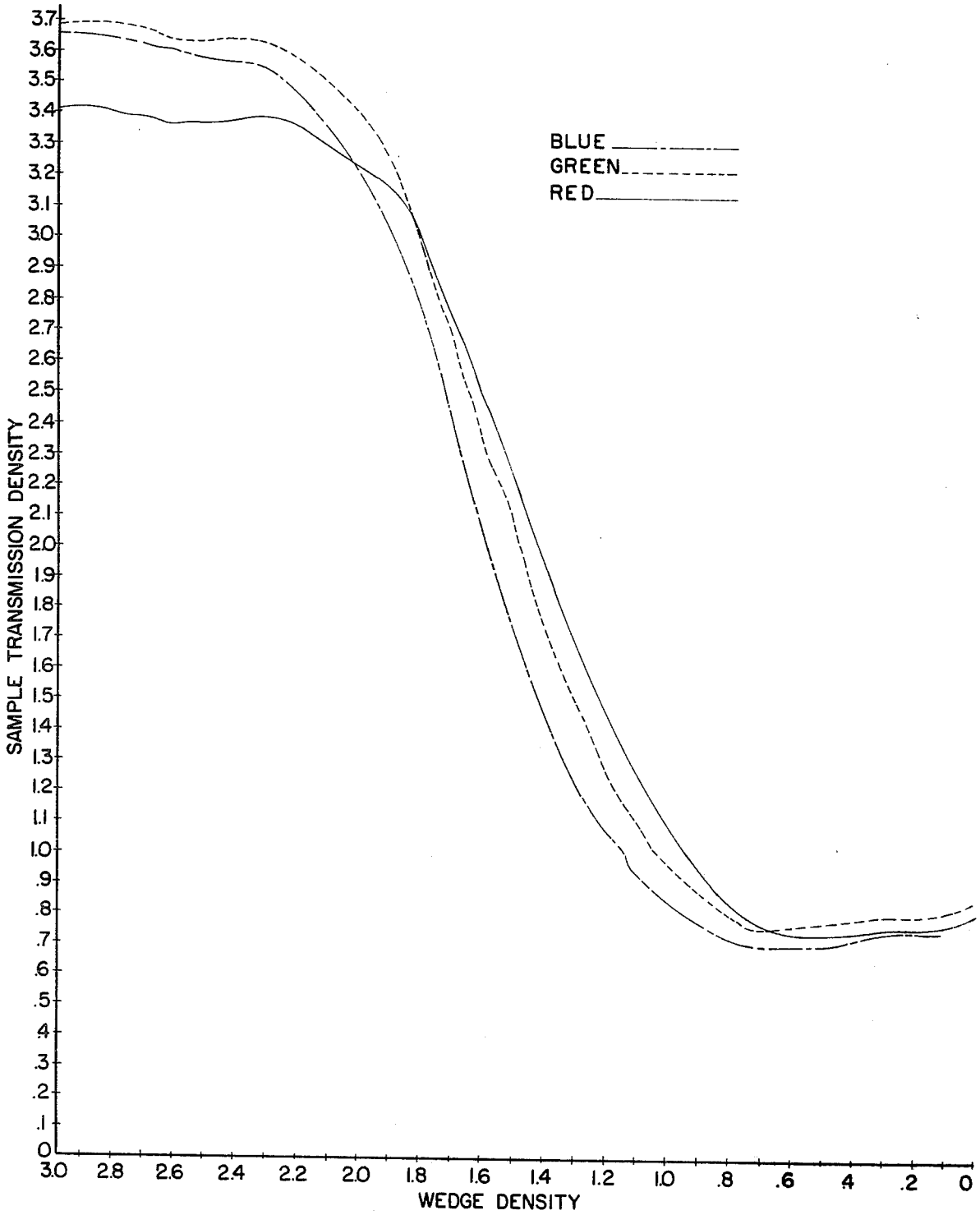
BLUE
GREEN
RED
SAMPLE TRANSMISSION DENSITY
3.7
3.6
3.5
3.4
3.3
3.2
3.1
3.0
2.9
2.8
2.7
2.6
2.5
2.4
2.3
2.2
2.1
2.0
1.9
1.8
1.7
1.6
1.5
1.4
1.3
1.2
1.1
1.0
.9
.8
.7
.6
.5
.4
.3
.2
.1
0
3.0 2.8 2.6 2.4 2.2 2.0 1.8 1.6 1.4 1.2 1.0 .8 .6 .4 .2 0
WEDGE DENSITY

METHOD FOR FORMING SILVER PRECIPITATING NUCLEI

BACKGROUND OF THE INVENTION

Procedures for preparing photographic images in silver by diffusion transfer principles are well known to the art. Thus, a silver diffusion transfer reversal process may provide a positive silver transfer image by development of the latent image provided by exposure of a photosensitive silver halide emulsion and, substantially contemporaneous with such development, a soluble silver complex is obtained, by reaction of a silver halide solvent with unexposed and undeveloped silver halide of the emulsion. The resultant soluble silver complex is, at least in part, transported in the direction of a suitable print-receiving element and the silver of the complex there precipitated to provide the requisite positive silver image formation.

The silver receptive stratum employed may be so constituted as to provide an unusually effective silver precipitating environment which causes the silver deposited therein, in comparison with negative silver developed in the silver halide emulsion, to possess an extraordinarily high covering power, that is, opacity per given mass of reduced silver; see Edwin H. Land, One Step Photography, Photographic Journal, section A, pp. 7–15, January 1950.

Specifically, to provide such environment, silver precipitation nuclei may be disposed within the silver receptive stratum in clusters possessing a diameter directly proportional to the mass of image silver to be deposited in situ by reduction. Such conformation can be employed to cause image silver to precipitate, in association with the silver precipitation nuclei clusters, with the required density and of a size directly related to the physical parameters of the clusters. The image silver thus precipitated in situ in galaxies of chosen physical parameters provides image conformation in which the elemental silver of the print-receiving element may possess a very high order of covering power, for example, five to fifteen or more times that of the negative elemental image silver in the silver halide element.

Additive color reproduction may be produced by exposing a photosensitive silver halide emulsion through an additive color screen having filter media or screen elements each of an individual additive color, such as red, or green or blue, and by viewing the reversed or positive silver image formed by transfer to a transparent print-receiving element through the same or a similar screen which is suitably registered with the reversed positive image carried by the print-receiving layer.

As examples of suitable film structures for employment in additive color photography, mention may be made of U.S. Pat. Nos. 2,861,885; 2,726,154; 2,944,894; 3,536,488; 3,615,427; 3,615,428; 3,615,429; 3,615,426; and 3,894,871.

U.S. Pat. No. 3,536,488 is directed to photosensitive silver halide crystals or grains dispersed in an environment containing silver precipitating nuclei or agents which in the presence of a solvent developer composition cause exposed grains to be reduced to opaque structures smaller in presented area than the area of the same grains developed in an identical developer composition absent such precipitating nuclei. Silver image masses derived from exposed silver halide grains developed in accordance with U.S. Pat. No. 3,536,488, accordingly, possess low optical covering power as compared with the covering power provided by identical grains developed in the same solvent developer absent the presence of the precipitating environment. Specifically, the patent provides for the production of a direct positive silver image in which the mass distribution of silver is substantially uniform macroscopically and nonuniform microscopically, and in which the transmissiveness of silver image mass is a function of the quantity of actinic radiation which exposed the photosensitive silver halide. The exposed silver halide grains are reduced, in situ, as compact masses possessing low covering power, simultaneously with reduction, in situ, of unexposed silver halide grains as a colloidal dispersion possessing high covering power. The direct positive silver image thus produced in situ possess extraordinary high sharpness when compared with transfer processes in which unexposed silver halide grains are dissolved and transferred to the ultimate image-carrying site. U.S. Pat. No. 3,536,488 is incorporated by reference herein in its entirety.

As set forth in U.S. Pat. No. 2,698,236 the array of silver atoms precipitated in the image-receiving element is influenced by the size of the silver-precipitating nuclei. If the silver-precipitating nuclei are relatively small, the silver deposited thereon will be of a corresponding size and, therefore, generally red in color which is undesirable. Clusters or galaxies of silver-precipitating nuclei possessing a diameter directly proportional to the mass of individual silver particles to be precipitated therein are disposed in the image-receiving layer to cause silver to precipitate in association with silver-precipitating nuclei clusters with a required density and of a size directly related to the physical parameters of the clusters, thus providing the desired black silver image.

It has also been found that silver precipitating nuclei disposed in a relatively thick layer, i.e., 1 micron or greater, also results in a redder image. While theories can be advanced for this phenomenon, the precise reason is not known.

Noble metal silver-precipitating nuclei are known to the art. Copending application Ser. No. 69,282 filed Aug. 24, 1979 (common assignee) discloses a method of forming such nuclei by the reduction of a noble metal salt or complex. U.S. Pat. No. 3,647,440 also discloses noble metal silver-precipitating nuclei obtained by reducing a metal salt in the presence of a protective colloid with a reducing agent having a standard potential more negative than −0.30.

Copending Application Ser. No. 897,944, filed Apr. 4, 1978 (common assignee), now U.S. Pat. No. 4,209,330 is directed to a method of forming clusters of noble metal silver-precipitating nuclei. Noble metal nuclei formed by the reduction of noble metal salts or complexes in colloidal suspension are formed into clusters by causing an instability in the colloid, i.e., by adjusting the pH of the colloid solution to at least about 2.6. If desired, the clusters may be employed at this point either by suitable separation techniques or by the addition of a bulking polymer to the colloid to impart stability to the clusters. If a separation technique is employed, the clusters may be allowed to floc, whereupon separation of the floc may be carried out by filtering and the like, and then redispersing the flocced particles in a suitable polymer binder with, preferably, sonification, and coating the thus-formed polymer/cluster mixture which may be coated on a support to provide an image-receiving element.

Such a method presents scale-up problems, and, in addition, the nuclei so produced must be used relatively soon after preparation to insure sensitometric uniformity in a product employing the nuclei.

A novel method for producing noble metal silver precipitating nuclei has now been found, which nuclei are particularly suited for use in the same layer as the photosensitive silver halide grains.

SUMMARY OF THE INVENTION

The present invention is directed to a method for forming noble metal silver precipitating nuclei by reducing a noble metal salt or complex in the presence of a first polymer with a Sn° colloid formed by the non-aqueous borohydride reduction of a tin salt in the presence of an organic solvent for the tin salt and a nitrogen-containing metal chelating polymer. The invention is also directed to film units employing said nuclei.

The FIGURE is a characteristic curve of a film unit of the present invention.

DETAILED DESCRIPTION OF THE INVENTION

As stated above, a problem often encountered in the formation of noble metal silver precipitating nuclei involves the particle size of the nuclei formed as a result of the reduction of the noble metal salt or complex. For ease of manufacturing and uniformity of the product, it is preferred to form nuclei of the desired size during the reduction stage without an additional operation to form the desired clusters.

Copending application Ser. No. 108,455 filed concurrently herewith (common assignee) in the names of Raymond B. Hanselman, John J. Magenheimer and Kenneth G. Scott, is directed to the reduction of noble metal salts or complexes by a $BH_4^-/Sn^\bullet$ complex wherein the term "$BH_4^-/Sn^\bullet$ Complex" is intended to refer to a suspension formed by the reduction of tin salts by alkali metal borohydride in an aqueous acidic medium. It has now been found that superior results are obtained when the tin salts are reduced by borohydride in the presence of organic solvent for the tin salt and a nitrogen-containing metal chelating polymer. By the process of the present invention, a true colloid is formed as opposed to the suspension formed according to the procedure of copending application Ser. No. 108,455.

The organic solvent used herein is any non-hydroxylic organic solvent for tin salts which will avoid hydrolysis of the tin salt during reduction. Hydrolysis of the tin salt releases acid which liberates $H^+$ as a side reaction, which may also consume borohydride. As examples of suitable solvents, mention may be made of dimethyl formamide, dimethyl sulfoxide and water-soluble amines.

The polymer selected is one which will possess chelating ability and is believed to assist in the formation and maintainance of the Sn° colloid, at least in part by controlling the particle size. The polymer may also function in the nuclei cluster formation.

As examples of suitable nitrogen-containing, metal chelating polymers suitable for use in the present invention, mention may be made of polyvinylpyrrolidone, gelatin and vinyl pyrrolidone/dimethylamino ethylmethacrylate copolymer.

Any water-soluble tin salt which is reducible by borohydride may be employed. As examples of such tin salts, mention may be made of stannous chloride, stannous bromide, stannous flouride, stannous acetate and stannic chloride.

By means of the present invention, clusters of nuclei of about 10–50 nm are formed as a relatively stable colloid. Nuclei formed by the procedure of the present invention are particularly suitable for use in film units wherein nuclei are disposed in the same layer as the photosensitive silver halide grains as well as in receiving layers which do not include silver halide grains.

The noble metals employed in the present invention include gold, palladium and platinum. Particularly superior results are achieved at the specified coverages with palladium. For convenience, the invention will be described primarily in terms of this preferred embodiment.

Combinations of noble metals may be used as well as single noble metals. In a preferred embodiment, noble metal salts or complexes may be reacted with the above-described complex reducing agent to provide the desired noble metal nuclei. Suitable compounds include the following:

$K_2PdCl_4$
$PdCl_2$
$H_2PtCl_6$
$AgNO_3$
$HAuCl_4$

The borohydride reducing agent is employed in a quantity which provides for the substantially complete reduction of the tin salt.

It should be noted that the compound used to reduce the stannous salt is critical. For example, while sodium hypophosphite, ascorbic acid and methanol will reduce palladous salts to Pd° they will not reduce stannous salts. Further, titanium (III) chloride will reduce stannous salts to Sn•, however, such a reduction is not suitable for the present invention since the Sn° plated out on the walls of the reaction vessel rather than remaining in suspension.

The presence of the first polymer during nuclei preparation is to maintain the noble metal nuclei as a colloid and sufficient polymer is employed to prevent precipitation. Such polymers employed in nuclei preparation are known to the art.

The silver precipitating layer employing the nuclei of the present invention may contain other polymers in addition to the one employed in nuclei formation. Such polymers are known to the art and include hydroxyethyl cellulose and polyvinyl hydrogen phthalate.

EXAMPLE A

Nuclei Preparation

To 212 ml N,N-dimethylformamide was added 3.75 g stannous chloride dihydrate (stored under nitrogen) with continuous nitrogen sparging. To the stirred sparged solution was added 1.0 g polyvinylpyrrolidone (M.W. 360,000) followed by 0.4 g sodium borohydride dissolved in 35 ml N,N-dimethylformamide. The thus-formed colloid was diluted with 1050 ml distilled water, heated to 40° C., and mixed with 18.8 g 20% gelatin, under a nitrogen blanket. 29.6 g palladium chloride (8.62% as $Pd^{+2}$ and 3.65% as HCl) was then added to the colloid. The mixture was then heated and stirred for 10 minutes and then dialyzed to a conductivity of less than about 200 umhos. The dimethylformamide is removed by the dialysis. The noble metal nuclei colloid is stabilized for refrigeration by the addition of 285 g of 20% gelatin per kg. of dialisate.

EXAMPLE 1

A film unit was prepared comprising a transparent polyester film base carrying on one surface an additive color screen of approximately 1500 triplets per inch of red, blue and green filter screen elements in repetitive side by side relationship; 328 mgs./ft.$^2$ of polyvinylidene chloride protective overcoat layer; an emulsion/silver-precipitating layer prepared in the following manner;

The following ingredients were combined in order as listed at 40° C.

59.28 g, 5% propolylene glycol alginate, 162.1 g nuclei mix prepared from the procedure of Example B, 99.5 g distilled water, 35.08 g of 24% gelatin, 50.6 g of 25% carboxylated styrene/butadiene copolymer latex (Dow 620, Dow Chemical Co., Midland, Michigan).

The thus-formed premix was then filtered through a 10μ Cox filter under nitrogen pressure and 343.6 g of the filtered premix was combined with 234 g of a panchromatically sensitized silver iodobromide emulsion having a grain size of about 0.72μ with a 0.827 gel to silver ratio. The thus-formed emulsion mix was coated over the above-identified protective overcoat layer at a coverage of 150 mgs/ft.$^2$ of silver and 0.8 mgs./ft.$^2$ of nuclei. Panchromatic sensitization was provided with 5,5'-dimethyl-9-ethyl-3,3'-bis-(3-sulfopropyl) thiacarbocyanine-triethyl-ammonium salt (0.53 mg/g Ag); 5,5'-diphenyl-9-ethyl-3,3'-bis-(4-sulfobutyl) oxacarbocyanine (1.0 mg/g Ag); anhydro 5,6-dichloro-1, 3-diethyl-3'-(4''-sulfobutyl)benzimidazolothiacarbocyanine hydroxide (1.0 mg/g Ag); and 3-(3-sulfopropyl)-3'-ethyl-4,5-benzothia-thiacyanine betaine (1.25 mg/g Ag); red, green, green and blue sensitizers respectively.

The following top coat was provided over the emulsion layer.

| Top Coat | mgs./ft.$^2$ |
|---|---|
| Gelatin | 341 |
| Dow 620 (carboxylated styrene/butadiene copolymer latex; Dow Chemical Co., Midland, Michigan) | 175 |
| Propylene glycol alginate | 25.7 |
| Dioctyl ester of sodium sulfosuccinate | 1.2 |
| $Au^{+1}$ complex of methylthioglycolate | 10 (as gold) |
| Pyridinium bis-1,5 (1,3-diethyl-2-thiol-5-barbituric acid) pentamethine oxanol (silver complex) | 5.6 |

The film units prepared according to the above procedure were given a 16 mcs exposure with a Xenon sensitometer and processed with mechanical rollers at a 0.0012 in. gap disposing the below indicated processing composition between the top coat and a polyethylene terephthalate cover sheet.

| Processing Composition | Weight % |
|---|---|
| Sodium hydroxide | 8.4 |
| Hydroxyethyl cellulose (sold by Hercules, Inc., Wilmington, Delaware under the tradename Natrosol 250 HH) | 0.6 |
| Tetramethyl reductic acid | 7.0 |
| Potassium bromide | 0.6 |
| Sodium sulfite | 0.8 |
| 2-methylthiomethyl-4,6-dihydroxypyrimidine | 7.0 |
| 4-aminopyrazolo-[3,4d]-pyrimidine | 0.02 |
| N-benzyl-α-picolinium bromide (50% solution) | 3.5 |
| Water | 66.6 |
| $Na_2B_4O_7 \cdot 10H_2O$ | 3.3 |
| Glycerine | 1.7 |
| p-isononyl phenoxy polyglycidol (containing about 10 glycidol units) | 0.5 |

The film units were then held in the dark for 30 minutes and the cover sheets were then removed, retaining the rest of the film unit together, and air drying. The spectral data shown in the attached figures were obtained by reading the neutral column to red, green and blue light in an automatically recording densitometer.

While the invention was described primarily in terms of an additive color system, it should be understood that the noble metal nuclei prepared according to the procedure of the present invention are also suitable for use in black and white silver diffusion transfer systems.

The support employed in the present invention is not critical. The support or film base employed may comprise any of the various types of transparent rigid or flexible supports, for example, glass, polymeric films of both the synthetic type and those derived from naturally occurring products, etc. Especially suitable materials, however, comprise flexible transparent synthetic polymers such as polymethacrylic acid, methyl and ethyl esters; vinyl chloride polymers; polyvinyl acetals; polyamides such as nylon; polyesters such as the polymeric films derived from ethylene glycol terephthalic acid; polymeric cellulose derivatives such as cellulose acetate, triacetate, nitrate, propionate, butyrate, acetate-butyrate; or acetate propionate; polycarbonates; polystyrenes; and the like.

The additive color screen employed in the present invention may be formed by techniques well known in the art, e.g., by sequentially printing the requisite filter patterns by photomechanical methods. An additive color screen comprises an array of sets of colored areas or filter elements, usually from two to four different colors, each of said sets of colored areas being capable of transmitting visible light within a predetermined wavelength range. In the most common situations the additive color screen is trichromatic and each set of color filter elements transmits light within one of the so-called primary wavelength ranges, i.e., red, green and blue. The additive color screen may be composed of minute dyed particles, such as starch grains or hardened gelatin particles, intermixed and interspersed in a regular or random arrangement to provide a mosaic. A regular mosaic of this type may be made by the alternating embossing and doctoring technique described in U.S. Pat. No. 3,019,124. Another method of forming a suitable color screen comprises multi-line extrusion of the type disclosed in U.S. Pat. No. 3,032,008, the colored lines being deposited side-by-side in a single coating operation. Still another method is set forth in U.S. Pat. No. 3,284,208.

Silver halide solvents useful in forming the desired soluble complex with unexposed silver are well known and, for example, may be selected from the alkali metal thiosulfates, particularly sodium or potassium thiosulfates, or the silver halide solvent may be a cyclic imide, such as uracil, in combination with a nitrogenous base as taught in U.S. Pat. No. 2,857,274 issued Oct. 21, 1958 to Edwin H. Land or pseudouracils, such as the 4,6-dihydroxypyrimidines. While the silver halide solvent is preferably initially present in the processing composition, it is within this invention to initially position the silver halide solvent in a layer of the film unit, preferably in the form of a precursor which releases or generates the silver halide solvent upon contact with an alkaline processing fluid.

The processing composition may contain a thickening agent, such as an alkali metal carboxymethyl cellulose or hydroxyethyl cellulose, in a quantity and viscosity grade adapted to facilitate application of the processing composition. The processing composition may be left on the processed film or removed, in accordance with known techniques, as is most appropriate for the particular film use. The requisite alkalinity, e.g., a pH of 12–14, is preferably imparted to the processing composition, by materials such as sodium, potassium and/or lithium hydroxide. A wetting agent may be advantageously included in the processing composition to facilitate application thereof, particularly where the processing composition is applied in a very thin layer of low viscosity fluid.

Suitable silver halide developing agents may be selected from amongst those known in the art, and may be initially positioned in a layer of the photosensitive element and/or in the processing composition. Organic silver halide developing agents are generally used, e.g., organic compounds of the benzene or naphthalene series containing hydroxyl and/or amino groups in the para- or ortho-positions with respect to each other, such as hydroquinone, tert-butyl hydroquinone, toluhydroquinone, p-aminophenol, 2,6-dimethyl-4-aminophenol, 2,4,6-triaminophenol, etc. If the additive color transparency is one which is not washed after processing to remove unused silver halide developing agent, development reaction products, etc., the silver halide developing agent(s) should not give rise to colored reaction products which might stain the image or which, either unreacted or reacted, might adversely affect the stability and sensitometric properties of the final image. Particularly useful silver halide developing agents having good stability in alkaline solution are substituted reductive acids, particularly tetramethyl reductic acid, as disclosed in U.S. Pat. No. 3,615,440 issued Oct. 26, 1971 to Stanley M. Bloom and Richard D. Cramer, and $\alpha$-$\beta$-enediols as disclosed in U.S. Pat. No. 3,730,716 issued to Edwin H. Land, Stanley M. Bloom and Leonard C. Farney on May 1, 1973.

What is claimed is:

1. A method for forming noble metal silver-precipitating nuclei which comprises reducing a noble metal salt or complex in the presence of a polymer with a metallic tin colloid produced by the reduction of a tin salt with borohydride in the presence of an organic solvent for the tin salt and a nitrogen-containing metal chelating polymer.

2. The method of claim 1 wherein said noble metal salt or complex reduction is carried out in an aqueous solution.

3. The method of claim 2 wherein said polymer is gelatin.

4. The method of claim 1 wherein said organic solvent is N,N-dimethylformamide.

5. The method of claim 1 wherein said nitrogen-containing polymer is polyvinylpyrrolidone.

6. The method of claim 1 wherein said tin colloid is formed from an alkali metal borohydride and a stannous salt.

7. The method of claim 1 wherein said noble metal is palladium.

8. The method of claim 1 which includes the further step of dialyzing subsequent to the reduction of said noble metal salt or complex.

* * * * *